US005943971A

United States Patent [19]

Trickett et al.

[11] Patent Number: 5,943,971

[45] Date of Patent: Aug. 31, 1999

[54] MATTRESS PRODUCTION INCLUDING MOVEABLE MATTRESS SUPPORT SEWING TABLE

[76] Inventors: David Trickett, 9 Hardman Close, Cowpe, Rossendale, Lancastshire, United Kingdom, BB4 7DL; Paul Rodgers, Huccaby House, Greave Clough Drive, Bacup, Lancastshire, United Kingdom, OL13 9HP

[21] Appl. No.: 09/022,203

[22] Filed: Feb. 11, 1998

[30] Foreign Application Priority Data

Feb. 11, 1997 [GB] United Kingdom ..... 9702774

[51] Int. Cl.[6] ..... D05B 11/00

[52] U.S. Cl. ..... 112/2.1; 112/304

[58] Field of Search ..... 112/2.1, 470.12, 112/304, 217.1, 217.3, 470.23, 470.36; 198/300, 346.2, 750.1, 799, 804; 108/20, 22; 224/401; 269/909; 414/353, 398

[56] References Cited

U.S. PATENT DOCUMENTS

| | | | |
|---|---|---|---|
| 3,083,654 | 4/1963 | Cash, Sr. | 112/2.1 |
| 3,490,061 | 1/1970 | Docker | 112/2.1 |
| 4,794,873 | 1/1989 | Dordi et al. | 112/2.1 |
| 4,821,656 | 4/1989 | Dordi et al. | 112/2.1 |
| 5,197,590 | 3/1993 | Prim et al. | 198/300 |
| 5,515,796 | 5/1996 | Ogle et al. | 112/2.1 |

OTHER PUBLICATIONS

Dime Grove Engineering Ltd. Brochure (2 pages).

*Primary Examiner*—Ismael Izaguirre
*Attorney, Agent, or Firm*—Jeffer, Mangels, Butler & Marmaro LLP

[57] ABSTRACT

A mattress support table with conveyor receives a mattress from a feed conveyor. The support table then indexes to a central position whereat a sewing machine passes around the periphery to sew the uppermost fabric panel to the border panel. The table then indexes to the exit conveyor and discharges the sewn mattress to be turned over, whereupon the mattress is returned to the support table to sew a bottom fabric panel. The table conveyor may be moved with a sewing machine so that an edge of the mattress is presented to the table periphery thereby allowing the sewing machine access to the edge.

16 Claims, 6 Drawing Sheets

MATTRESS PRODUCTION INCLUDING MOVEABLE MATTRESS SUPPORT SEWING TABLE

FIELD OF THE INVENTION

The present invention relates to improved methods and apparatus for mattress production, and more particularly to such methods and apparatus for the sewing and handling of mattresses.

BACKGROUND OF THE INVENTION

It is to be understood that the term "mattress" is used hereinafter in the claims and description to incorporate cushions or similar items.

A mattress comprises a spring assembly enclosed within a fabric structure that comprises a top fabric panel, a bottom fabric panel and a border fabric panel that encloses the periphery of the spring assembly and is sewn at its peripheral edges to the top and bottom fabric panels respectively.

Conventional edge sewing apparatus (also known as a tape edging machine) comprises a support table around the periphery of which a sewing machine carriage moves on a rail or frame. The sewing machine carriage completes one pass of the periphery of the support table in stitching the top fabric panel to the border panel, the mattress is then turned over by an operator and the border panel is sewn to the bottom panel (now uppermost) in a second pass of the sewing machine.

A machine operator guides the sewing machine carriage around the periphery of the stationary mattress and support table by standing to one side of the sewing machine and walking it backwards around the support table. During sewing the operator ensures that the mattress is fed into the sewing machine correctly to ensure secure and even stitching is produced. This method of sewing is well established and it has proved difficult to encourage operators to adapt to or accept new methods of sewing.

Conventional mattress edge sewing techniques involve significant man" effort in manipulating heavy and large mattresses and it is therefore desirable to minimize the effort required by the operator to sew a mattress.

Often a mattress is larger or smaller than the size of the support table in which case additional operator effort is required in moving the mattress around the table to ensure that an edge to be sewn is presented to the sewing machine at a periphery of the table.

In a contemporary mattress sewing machine, mattresses are conveyed past a stationary sewing machine by a conveyor belt on the support table. The mattress is rotated so that all four sides of the border and top panel are presented to sewing machine in sequence before the mattress is automatically turned over and the process is repeated to secure the bottom panel to the border. This apparatus has met with resistance from operators familiar with the older technology referred to above.

A need exists to obviate or mitigate die aforesaid disadvantages and provide an improved method and apparatus for mattress production, to improve the production flow and to reduce operator fatigue by eliminating the need to lift or otherwise manipulate heavy mattresses

SUMMARY OF THE PREFERRED EMBODIMENTS

According to a first aspect of the present invention there is provided mattress production apparatus comprising a mattress support table and a sewing machine moveable around a periphery of the table, a feed conveyor and an exit conveyor on either side of the mattress support table, wherein the mattress support table includes a conveyor for conveying a mattress along the table and wherein the mattress support table and the feed conveyor and exit conveyor are moveable relative to one another moveable between a first position in which the mattress support table is adjacent the feed conveyor so as to be in a position to receive an unsewn mattress and a second position in which the mattress support table is adjacent the exit conveyor so as to be in a position to discharge a sewn mattress.

The mattress support table may be stationary with the feed and exit conveyors moveable in sequence relative thereto, or alternatively, the mattress support table is moveable between stationary feed and exit conveyors in which case the support table is conveniently mounted on a trolley that is moveable between the feed and exit conveyors.

Preferably there is provided means for turning over mattress. Such means may be fed by the exit conveyor, alternatively it may be provided at or on the exit conveyor. There may also be provided means for reversing the conveyors to feed mattress back once it is turned over.

According to a second aspect of the present invention there is provided a method of mattress production comprising the steps of supplying an unsewn mattress on an feed conveyor to a mattress support table, making a first pass of a sewing machine around the periphery of the table so as to sew an uppermost panel of the mattress, automatically moving the support table or the exit conveyor until they are adjacent, operating a conveyor on the support table to transfer the mattress to the exit conveyor and a mattress turning station, turning the mattress over at the mattress turning station, receiving the turned mattress on the support table, making a second pass of the sewing machine to sew the uppermost panel, moving the support table or the exit conveyor until the two are adjacent and transferring the sewn mattress to the exit conveyor.

The exit conveyor may transfer the mattress to a separate turning station or alternatively the mattress turning station may be located at the exist conveyor. The table conveyor and exit conveyor may be reversed to receive the mattress for a second pass of sewing machine.

The mattress may be raised at one end by the mattress turning station until the mattress is substantially on a side edge and the exit conveyor is then moved in a direction that causes the mattress to topple over so as to expose its unsewn panel.

According to a third aspect of the present invention there is provided a method of sewing a mattress on a support table using a sewing machine that is moveable relative to the support table, the mattress having a dimension that is longer or shorter than the support table, the method comprising the steps of presenting a first edge of the mattress to a periphery of the support and sewing around a significant portion of said first edge, operating a conveyor on said support table so as to move said mattress in a direction parallel to said dimension thereby presenting a second edge to the support table periphery, moving said sewing machine simultaneously with the mattress and sewing around the second edge of the mattress.

The sewing machine may move at same speed as conveyor or, alternatively, at a different speed to conveyor so that sewing occurs during movement of conveyor and mattress.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
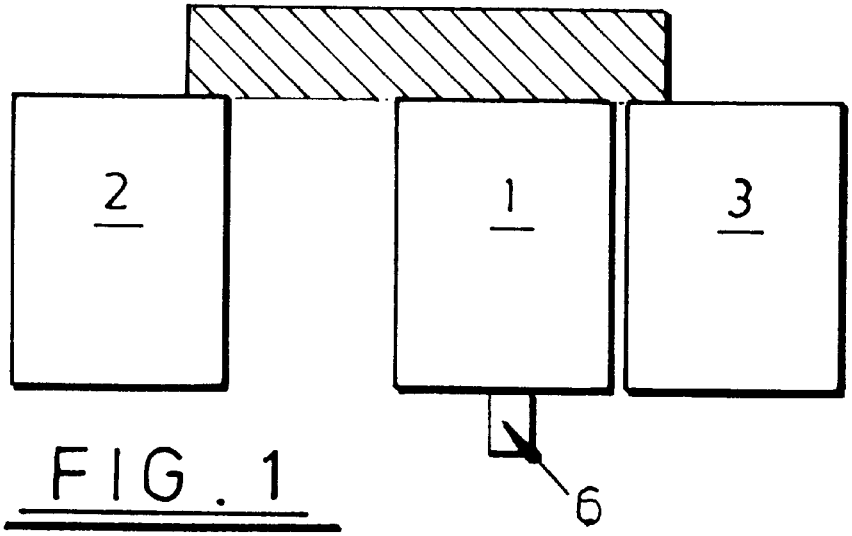
FIG. 1 is a schematic plan view in block form of mattress production apparatus in accordance with the present invention.

Referring now to the drawings, FIG. 1 shows, in schematic block form, a mattress sewing station comprising a mattress support table 1 that is moveable between fixed feed and exit conveyors 2,3.

The support table 1 comprises conveyor 4 mounted on a wheeled structure 5 such as a trolley and has a peripheral frame or track (not shown) on which a sewing machine carriage 6 is mounted such that it is moveable along the rail about the periphery of the support table 1. There is a clearance around the periphery of the table 1 to permit passage of the sewing machine carriage 6 and the operator during sewing.

Figure 1A:
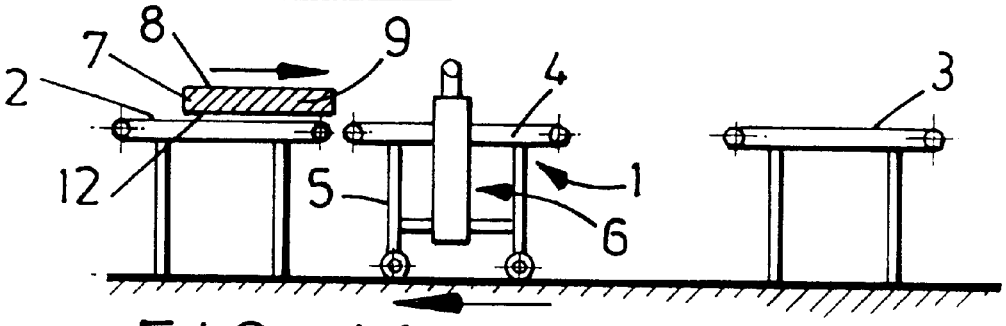
FIGS. 1A–1C are side schematic views illustrating the apparatus and the steps in the method of mattress production of the first and second aspects of the present invention.
Figure 1B:
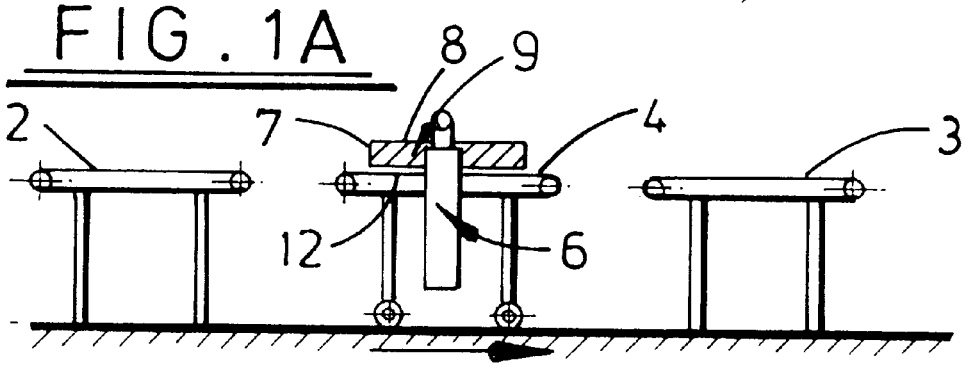
Figure 1C:
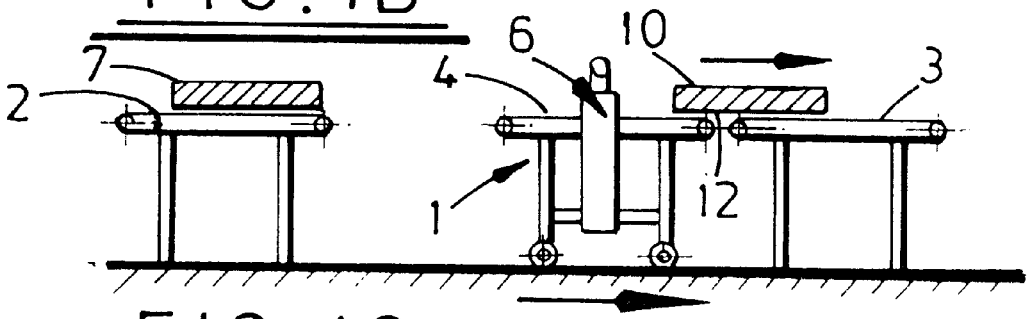

In operation an unsewn mattress 7 (FIGS. 1A to 1C) is transferred to the support table 1 by the feed conveyor 2 with the support table 1 in a position immediately adjacent the feed conveyor 2 as illustrated in FIG. 1A. The mattress 7 is centrally positioned on the support table 1 by operation of its conveyor 4. The support table 1 then automatically indexes to a central position (see FIG. 1B) intermediate the feed and exit conveyors 2, 3 where there is sufficient clearance for the sewing machine carriage 6 to move around the support table 1. A top fabric panel 8 of the mattress is then sewn to the peripheral edge of a border fabric panel 9 by the sewing machine which passes along the track around the periphery of the support table 1. When the sewing operation is complete the support table 1 indexes to the position shown in FIG. 1C. Here the support table conveyor 4 is operated to transfer the partially sewn mattress 10 to the adjacent exit conveyor 3. The mattress 10 is then transferred to a station (not shown) where it is turned over in a conventional manner and returned to the exit conveyor 3. The direction of the exit conveyor 3 and the support table conveyors 4 are reversed so that the tamed mattress is returned to the support table 1 which then reverts to the central position shown in FIG. 1B. The sewing machine carriage 6 makes a second pass of the table 1 sewing a bottom fabric panel 12 (now uppermost) to a peripheral edge of the border panel 9. The completed mattress is then transferred to the exit conveyor 3 as shown in FIG. 1C and the operation is repeated on a new unsewn mattress.

The above described arrangement provides for a production process in which the handling of the mattress is automated but the sewing operation remains relatively unchanged thereby obviating need to retrain sewing machine operators. The use of feed and exit conveyors together with a moveable table improves the production rate and significantly reduces operator effort in handling the heavy mattresses.

It will be appreciated that as an alternative to moving the table 1 relative to the feed and exit conveyors 2, 3, the feed and exit conveyors 2, 3 may be separately moveable relative to a stationary support table 1 (not shown in the drawings). It should also be understood that the height of the table 1 and conveyors 2, 3 is adjustable by known means (such as hydraulic or pneumatic actuators) to accommodate different mattress thicknesses.

Referring now to FIGS. 2A to 2D, the present invention is also concerned with the sewing of a mattress 20 that is larger or smaller in one dimension than the support table 1. The figures illustrate in sequence a sewing operation that can be used separately or in combination with the apparatus described in relation to FIGS. 1 and 1A to 1C.

In the drawings the mattress 20 is shown with its longer (major) edge 21 being of comparable length to the corresponding dimension 22 of the support table 1 and its shorter (minor) edge 23 being significantly shorter than the corresponding dimension of the support table 1. In this situation only three edges of the mattress 20 arc presented to the periphery of the support table 1, a second major edge 24 being in- board of the support table 1. The sewing machine carriage 6 in passing around the periphery of the table is only therefore able to sew three edges of the mattress 20.

Figure 2A:
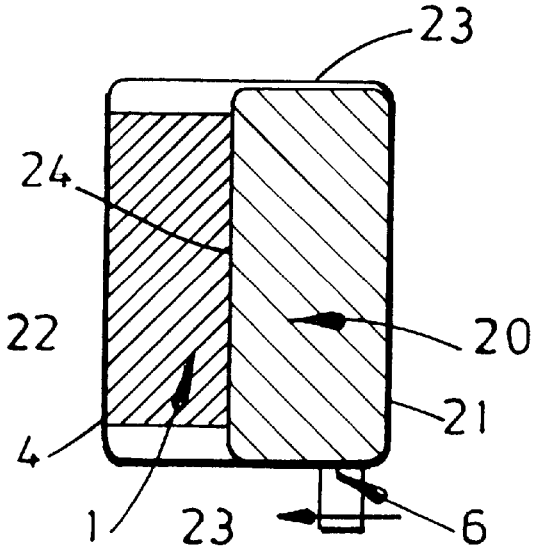
FIGS. 2A to 2D are schematic plan views illustrating the steps in the mattress production method according to the third aspect of the present invention.
Figure 2B:
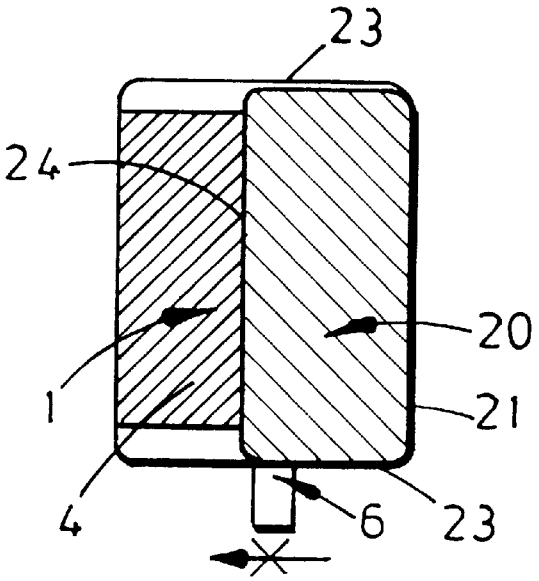
Figure 2C:
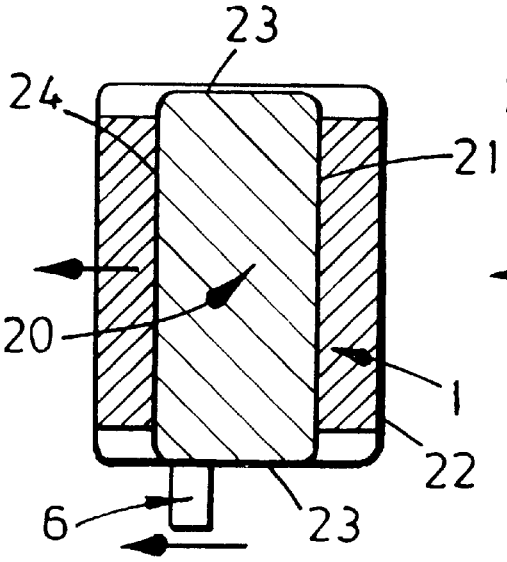
Figure 2D:
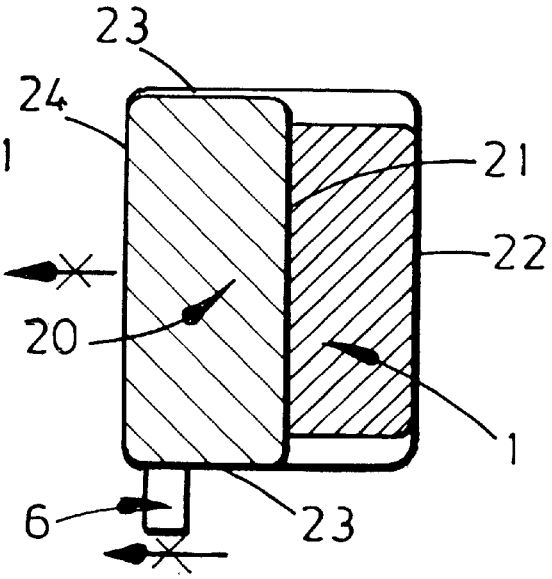

When the sewing machine carriage 6 reaches the position shown in FIG. 2B it has completed the sewing of three edges and the conveyor 4 is operated to move the mattress 20 so that the second major edge 24 is presented to the support table 1 periphery. The sewing machine carriage 6 moves concurrently with the conveyor 4 and mattress 20 as shown in FIG. 2C. When the mattress 20 has reached the position shown in FIG. 2C the second major edge 24 is exposed to the support table 1 periphery and the sewing machine carriage 6 passes along that edge 24 to complete the sewing operation. The mattress 20 is then conveyed from the support table 1 for turning or removal.

The sewing machine carriage 6 may move with the conveyor 4 and mattress 20 at the same speed with the sewing operation temporarily arrested until the mattress 20 is in position or alternatively it may move at speed greater than that of the mattress 20 so that sewing may still be performed during movement of the latter. It will be understood that in the latter case movement of the conveyor 4 and mattress 20 should therefore commence before the sewing of the minor edge 23 is complete so that by the time the mattress has reached the desired position sewing of the minor edge 23 is complete.

It will be appreciated that a similar operation can be performed when a support table carries a mattress that longer than the length of the conveyor. In this case the mattress would initially have an edge that overhung the table periphery and would have to be moved in the opposite direction to that described above. The sewing machine carriage could be operated at the same speed as the conveyor or alternatively sewing during movement of the conveyor could be achieved by having the sewing machine stationery or moving in the opposite direction to the conveyor and mattress.

An alternative embodiment of the mattress sewing apparatus of FIG. 1 is shown in FIGS. 3A to 3H. The principal difference between this embodiment and that described earlier is that the mechanism for turning over the mattress is provided at the exit conveyor rather than at a separate station and therefore a transfer step is eliminated.

The mechanism for turning over the mattress comprises a horizontal bar 30 that extends across the width of the exit conveyor 3 such that it is parallel to the upper surface of the conveyor 3. The bar 30 is supported between parallel guide tracks 31 that extend upwardly and inwardly from comers of the exit conveyor 3 at an end adjacent the support table 1. The mechanism for moving the bar 30 up and down the guide tracks 31 can be of any suitable form such as a motor and gear assembly or a hydraulic or pneumatic actuator.

In operation the mattress 7, having been sewn on its top panel 8 is then transferred to the exit conveyor 3. In order to do this the mattress support table 1 may move towards the exit conveyor 3 or vice versa. At this stage the bar 30 is stowed at its lowest point, below the level of the exit conveyor 3 surface. The support table conveyor 3 and the exit conveyor operate simultaneously until the mattress 7 reaches the position shown in FIG. 3A, where approximately two thirds of its length is supported on the exit conveyor 3. At this point the conveyors stop 10 traveling and the bar 30 travels up the guide rails 31 (see FIGS. 3C and 3D) until the mattress stands on its border edge panel 9. Here the bar 30 is at the end of its length of travel along the guide tracks 31. The stopping of the conveyors and initiation of the movement of the bar 30 may be controlled, for example, by the triggering of a proximity switch or the like.

Figure 3A:
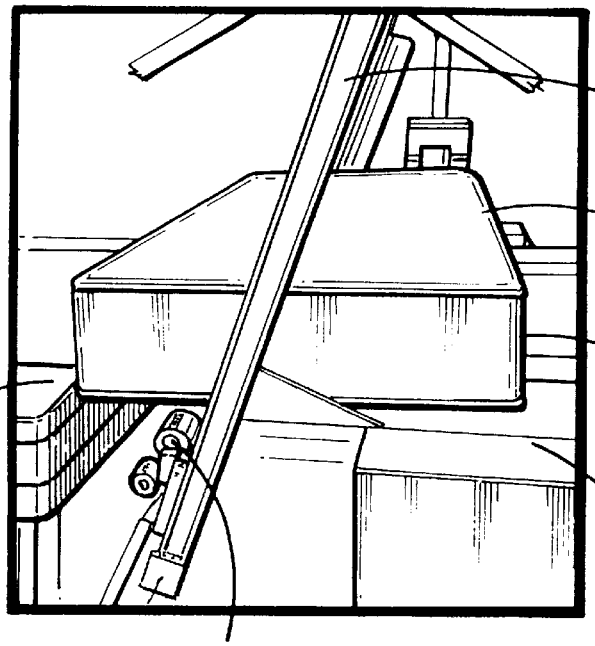
FIGS. 3A to 3H are perspective views of apparatus of the present invention showing a mattress turning mechanism.
Figure 3B:
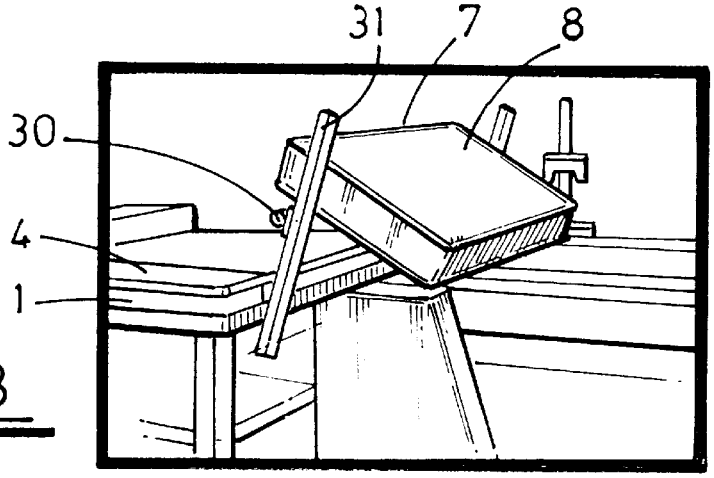
Figure 3C:
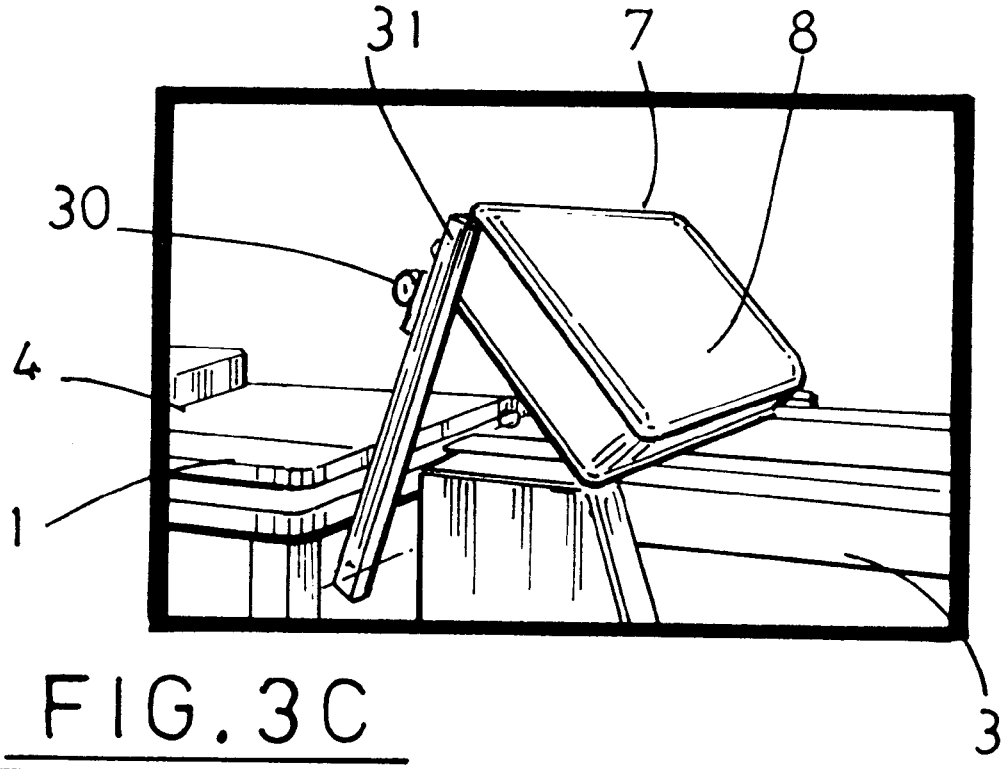
Figure 3D:
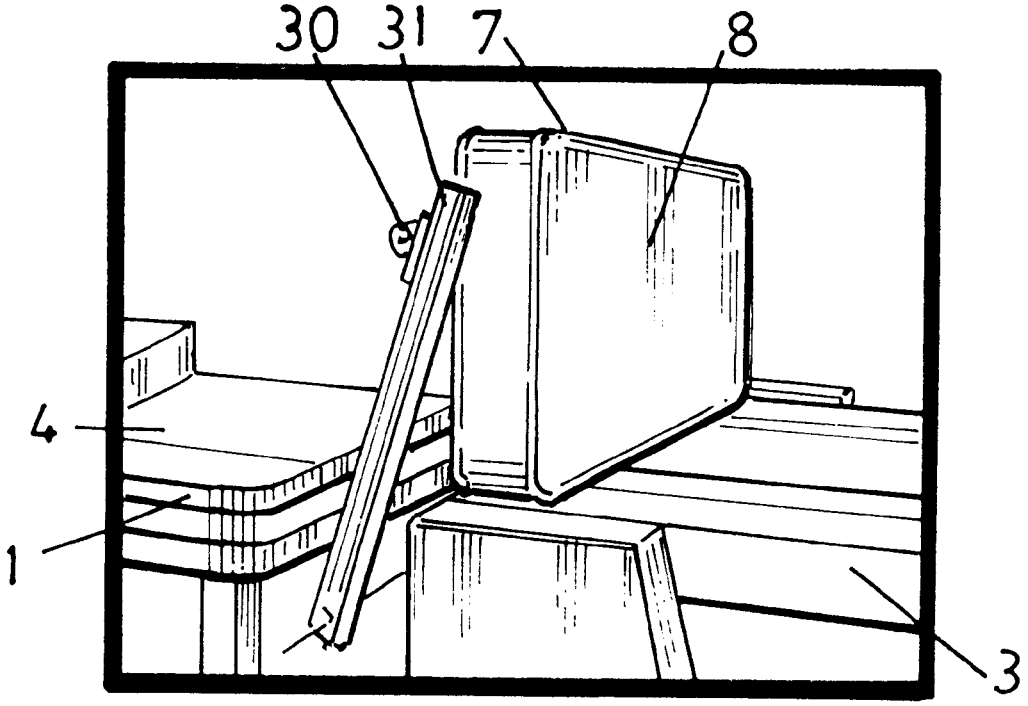
Figure 3E:
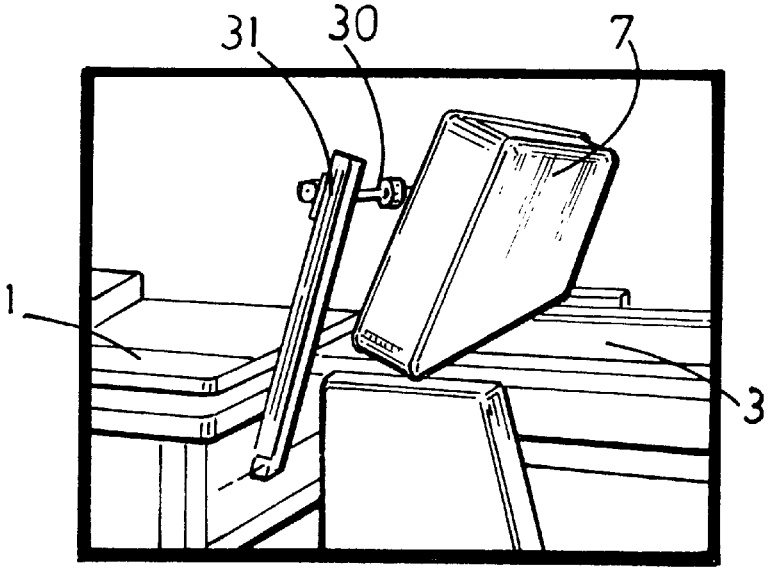
Figure 3F:
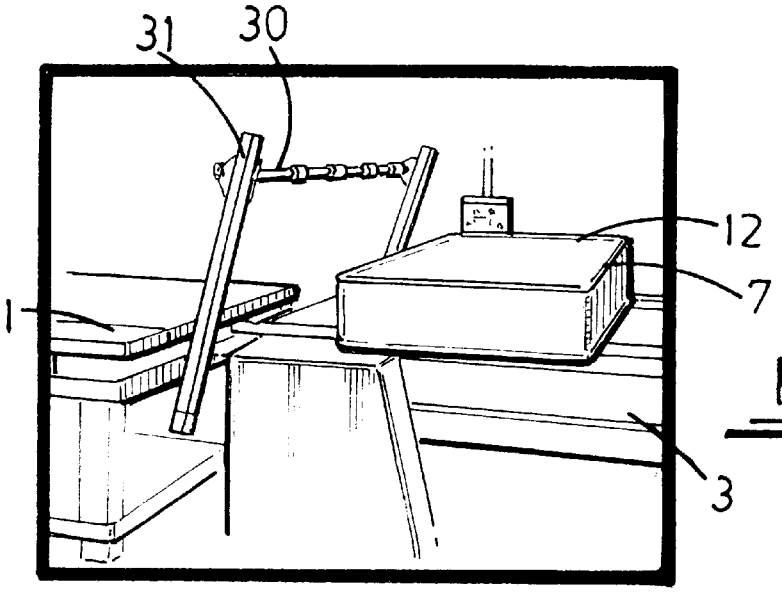
Figure 3G:
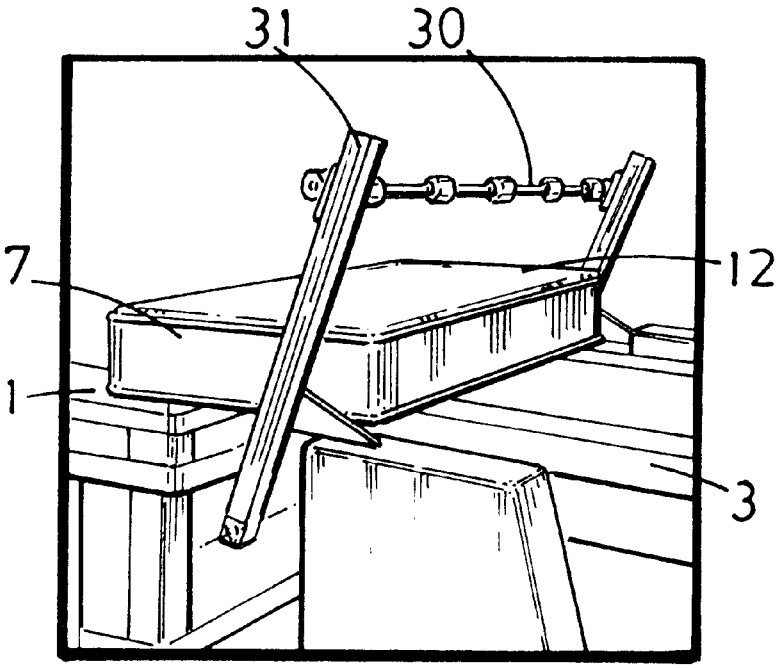
Figure 3H:
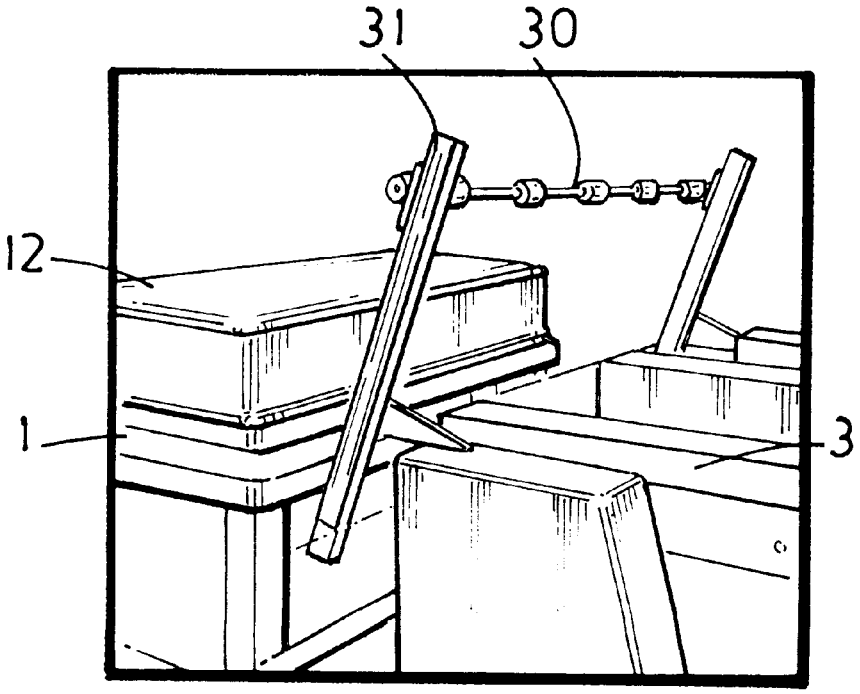

When the mattress 7 reaches the position as shown in FIG. 3E, the exit conveyor 3 reverses so that it moves the supported edge of the mattress 7 towards the mattress support table 1. The upper portion of the mattress 7 abuts the elevated bar 30 thereby causing the mattress 7 to topple over so as to expose it unsewn bottom panel 12 (see FIG. 3F).

The mattress 7 is then conveyed from the exit conveyor 3 to the mattress support table 1 by operation of the respective conveyors 3, 4.

What is claimed is:

1. Mattress production apparatus comprising a mattress support table and a sewing machine moveable around a periphery of the table, a feed conveyor and an exit conveyor on either side of the mattress support table, wherein the mattress support table includes a conveyor for conveying a mattress along the table and wherein the mattress support table and the feed conveyor and exit conveyor are moveable relative to one another moveable between a first position in which the mattress support table is adjacent the feed conveyor so as to be in a position to receive an unsewn mattress and a second position in which the mattress support table is adjacent the exit conveyor so as to be in a position to discharge a sewn mattress.

2. Mattress production apparatus according to claim 1, wherein the mattress support table is stationary and the feed and exit conveyors are moveable relative thereto.

3. Mattress production apparatus according to claim 1, wherein the support table is mounted on a trolley that is moveable between the feed and exit conveyors.

4. Mattress production apparatus according to claim 1 wherein there is provided means for turning over mattress.

5. Mattress production apparatus according to claim 4, wherein the exit conveyor incorporates said means for turning over mattress.

6. Mattress production apparatus according to claim 5, wherein there is provided means for reversing the direction of the exit and support table conveyors so that the mattress may be returned to the support table after it has been turned over.

7. Mattress production apparatus according to claim 4 wherein the means for turning over the mattress comprises an arm that is moveable upwards between a first position where it lies below or level with the surface of the exit conveyor and a second position where it is above the surface of the exit conveyor.

8. Mattress production apparatus according to claim 7, wherein the arm is in the form of a bar parallel to said exit conveyor and which moves between said first and second positions in guide tracks positioned on either side of the exit conveyor.

9. A method of mattress production comprising the steps of supplying an unsewn mattress on an feed conveyor to a mattress support table, making a first pass of a sewing machine around the periphery of the table so as to sew an uppermost panel of the mattress, automatically moving the support table or the exit conveyor until they are adjacent, operating a conveyor on the support table to transfer the mattress to the exit conveyor and a mattress turning station, turning the mattress over at the mattress turning station, receiving the turned mattress on the support table, making a second pass of the sewing machine to sew the uppermost panel, moving the support table or the exit conveyor until the two are adjacent and transferring the sewn mattress to the exit conveyor.

10. A method of mattress production according to claim 9, wherein the mattress turning station is located at the exit conveyor.

11. A method of mattress production according to claim 9, wherein the exit conveyor transfers the mattress to the turning station.

12. A method of mattress production according to claim 9 further comprising the steps of reversing the direction of the support table and exit conveyor when the turned mattress is to be received by the support table.

13. A method of mattress production according to claim 9 wherein the mattress is raised at one end by the turning station until the mattress is substantially on a side edge and thereafter the exit conveyor is moved in a direction that causes the mattress to topple over so as to expose its unsewn panel.

14. A method of sewing a mattress on a support table using a sewing machine that is moveable relative to the support table, the mattress having a dimension that is longer or shorter than the support table, the method comprising the steps of presenting a first edge of the mattress to a periphery of the support and sewing around a significant portion of said first edge, operating a conveyor on said support table so as to move said mattress in a direction parallel to said dimension thereby presenting a second edge to the support table periphery, moving said sewing machine simultaneously with the mattress and sewing around the second edge of the mattress.

15. A method according to claim 14, wherein the sewing machine moves at the same speed as the conveyor.

16. A method according to claim 14, wherein the sewing machine moves at a different speed to conveyor so that sewing occurs during movement of conveyor.

* * * * *